US008931215B1

(12) United States Patent
Cook et al.

(10) Patent No.: US 8,931,215 B1
(45) Date of Patent: Jan. 13, 2015

(54) ATTIC STAIRWAY INSULATOR ASSEMBLY

(71) Applicant: Owens Corning Intellectual Capital, LLC, Toledo, OH (US)

(72) Inventors: David M. Cook, Granville, OH (US); Anthony Rockwell, Pickerington, OH (US); Fawn M. Uhl, New Albany, OH (US); Harry Alter, Granville, OH (US); Julie Pope, Monroe, MI (US); Paul B. Machacek, Toledo, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 14/295,650

(22) Filed: Jun. 4, 2014

(51) Int. Cl.

| | |
|---|---|
| ***E04B 1/76*** | (2006.01) |
| ***E04B 9/00*** | (2006.01) |
| ***E04F 11/04*** | (2006.01) |
| ***E06B 7/16*** | (2006.01) |
| ***E06B 5/01*** | (2006.01) |
| ***E04B 1/74*** | (2006.01) |

(52) U.S. Cl.

CPC ..... *E04B 9/001* (2013.01); *E04B 9/003* (2013.01); *E04F 11/04* (2013.01); *E06B 7/16* (2013.01); *E06B 5/01* (2013.01); *E04B 1/74* (2013.01)

USPC ..... 52/19; 52/202; 52/404.1; 52/406.2; 52/741.4; 182/46; 49/463

(58) Field of Classification Search

USPC ..... 52/19, 20, 404.1, 406.1, 406.2, 202, 52/741.4; 182/46, 77

See application file for complete search history.

(56) References Cited

U.S. PATENT DOCUMENTS

| | | | |
|---|---|---|---|
| 4,151,894 | A | 5/1979 | Edwards |
| 4,281,743 | A | 8/1981 | Fuller |
| 4,312,423 | A | 1/1982 | Helbig |
| 4,337,602 | A | 7/1982 | King |
| 4,344,505 | A | 8/1982 | Waters et al. |
| 4,658,555 | A | 4/1987 | Steiner |
| 4,675,225 | A | 6/1987 | Cutler |
| 4,832,153 | A | 5/1989 | Daw et al. |
| 4,928,441 | A | 5/1990 | Daley |
| 4,944,126 | A | 7/1990 | King |
| 5,220,757 | A | 6/1993 | Hulligan |
| 5,271,198 | A | 12/1993 | Freeman |
| 5,274,966 | A | 1/1994 | Daley |
| 5,475,955 | A | 12/1995 | Dickinson |
| 5,623,795 | A | 4/1997 | Padgett, Jr. |
| 5,628,151 | A | 5/1997 | Monat |
| 5,792,540 | A | 8/1998 | Hughes |
| 5,848,509 | A | 12/1998 | Knapp et al. |
| 5,867,946 | A | 2/1999 | Seagreen |
| 6,014,841 | A | 1/2000 | McCoy, Jr. et al. |
| RE36,975 | E | 12/2000 | Williams |
| 6,223,490 | B1 | 5/2001 | Wessley et al. |

(Continued)

*Primary Examiner* — Robert Canfield

(74) *Attorney, Agent, or Firm* — Fraser Clemens Martin & Miller LLC; Charles F. Charpie

(57) ABSTRACT

An attic stairway insulator assembly configured for placement within a building scuttle is provided. The building scuttle has a length and a width. The attic stairway insulator assembly includes a base configured to cover the building scuttle. The base has a length and a width corresponding generally to the length and the width of the building scuttle. A bag is seated on the base and has insulative material within a jacket. The bag has a length that is longer than the length of the base and a width that is wider than the width of the base such that portions of the bag having the insulative material drape over portions of the base.

20 Claims, 5 Drawing Sheets

(56) References Cited

U.S. PATENT DOCUMENTS

| | | | |
|---|---|---|---|
| 6,223,760 | B1 | 5/2001 | Hughey |
| 6,578,327 | B1 | 6/2003 | Hackbarth et al. |
| 6,601,352 | B1 | 8/2003 | Obermeyer et al. |
| 6,701,676 | B1 | 3/2004 | Kompelien |
| 6,966,153 | B2 | 11/2005 | Panetta et al. |
| 7,337,584 | B2 | 3/2008 | Viens |
| 7,434,363 | B2 | 10/2008 | Panetta et al. |
| 7,650,722 | B1 | 1/2010 | Melesky |
| 7,690,165 | B2 | 4/2010 | Taylor |
| 7,770,353 | B2 | 8/2010 | Olsen |
| 7,836,638 | B2 | 11/2010 | Ogieglo |
| 7,849,644 | B2 | 12/2010 | Melesky |
| D632,804 | S | 2/2011 | Afasano |
| 7,926,229 | B2 | 4/2011 | Melesky |
| 8,117,786 | B1 | 2/2012 | Tobbe |
| 8,413,393 | B2 | 4/2013 | Melesky |
| 8,438,789 | B2 | 5/2013 | Uhl et al. |
| 2002/0112409 | A1 | 8/2002 | Knowles |
| 2004/0055819 | A1 | 3/2004 | Lynn et al. |
| 2004/0163345 | A1 | 8/2004 | Alderman |
| 2006/0010806 | A1 | 1/2006 | Panetta et al. |
| 2009/0094908 | A1 | 4/2009 | Krueger et al. |
| 2009/0133342 | A1 | 5/2009 | Copeland |
| 2010/0107510 | A1 | 5/2010 | Copeland |
| 2011/0138713 | A1 | 6/2011 | Reed |
| 2011/0225899 | A1 | 9/2011 | Melesky |
| 2011/0236621 | A1 | 9/2011 | Sampson |
| 2012/0060427 | A1 | 3/2012 | Taylor et al. |
| 2012/0186179 | A1 | 7/2012 | Melesky |
| 2012/0328807 | A1 | 12/2012 | Grimes |
| 2013/0219804 | A1 | 8/2013 | Uhl et al. |
| 2013/0232880 | A1 | 9/2013 | Cook et al. |

ATTIC STAIRWAY INSULATOR ASSEMBLY

BACKGROUND

Commercial and residential buildings, such as for example, offices, homes and apartments are formed from various structures that define interior spaces within the building. Non-limiting examples of the various structures include walls, windows, floors, crawl spaces and roofs. In addition to defining the building's interior spaces, the various structures can separate air located within the building's interior spaces with air external to the building.

In certain instances, the internal air may be conditioned for desired characteristics, such as for example, temperature and humidity qualities. In these instances, the energy efficiency of these buildings can be affected by insulating the various structures separating the internal air from the external air.

Another structure commonly formed within buildings is an attic stairway. The attic stairway is intended to provide access from a lower level of the building to an upper level, such as an attic. An attic stairway can be formed with an opening in a floor of the attic and an associated attic stair. The attic stair can be formed as a set of stairs that extend from the attic to a lower level of the building. In certain instances, the attic stair can be configured to contract to a nested arrangement in the attic floor.

While it is known to insulate attic floors to provide a desired thermal insulative value (R-value), it has been difficult to insulate attic stairways to provide thermal insulative values that are equivalent to the thermal insulative values of the insulation material applied to the attic floors surrounding the attic stairway.

It would be advantageous if attic stairways could be insulated more effectively.

SUMMARY

In accordance with embodiments of this invention there is provided an attic stairway insulator assembly configured for placement within a building scuttle. The building scuttle has a length and a width. The attic stairway insulator assembly includes a base configured to cover the building scuttle. The base has a length and a width corresponding generally to the length and the width of the building scuttle. A bag is seated on the base and has insulative material within a jacket. The bag has a length that is longer than the length of the base and a width that is wider than the width of the base such that portions of the bag having the insulative material drape over portions of the base.

In accordance with other embodiments, there are also provided a method of insulating a building scuttle, the building scuttle having a length and a width. The method includes the steps of covering the building scuttle with a base, the base having a length and a width corresponding generally to the length and the width of the building scuttle, seating a bag on the base, the bag having a length that is longer than the length of the base and a width that is wider than the width of the base and inserting insulative material into the seated bag such that portions of the bag having the insulative material drape over portions of the base.

Various advantages of the attic stairway insulator will become apparent to those skilled in the art from the following detailed description of the invention, when read in light of the accompanying drawings.

DETAILED DESCRIPTION

Figure 1:
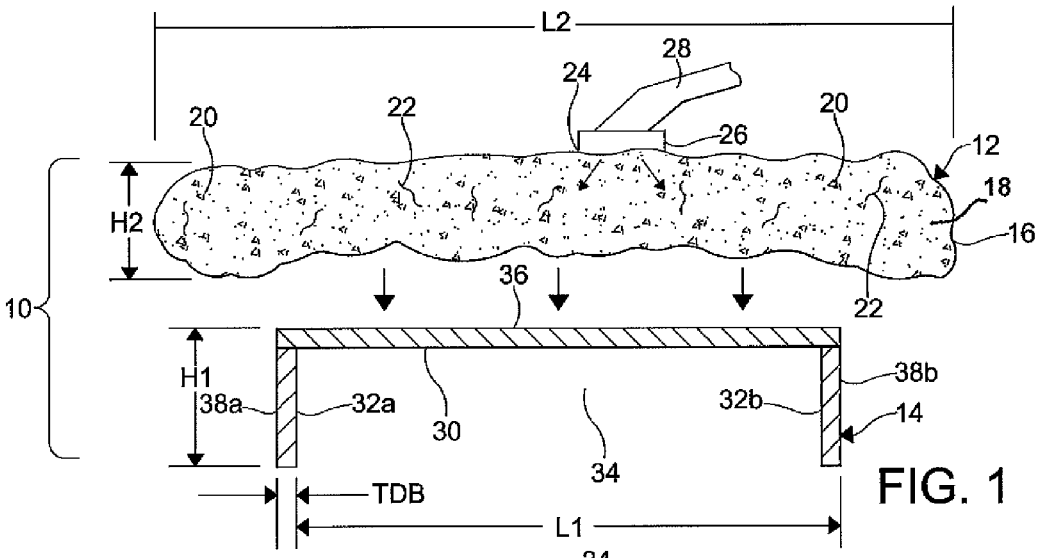
FIG. 1 is an exploded side view, in cross-section, of a first embodiment of an attic stairway insulator assembly, for use with a scuttle opening.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, an attic stairway insulator assembly is provided. The term "building", as used herein, is defined to mean any commercial, residential or industrial structure. The term "building structure" as used herein, is defined to mean any assembly or system constructed as part or portion of a building. The term "scuttle", as used herein, is defined to mean a framed opening configured to provide access to an attic. The term "attic", as used herein, is defined to mean an open space at an upper level of a building, just below the roof. The term "batt", as used herein, is defined to mean an elongated blanket of fibrous insulation.

The description and figures disclose an attic stairway insulator assembly and methods of assembling and installing the attic stairway insulator assembly. The attic stairway insulator assembly is configured to prevent or substantially retard the flow of air passing through the attic scuttle from the interior spaces of the building to the attic or from the attic to the interior spaces of the building. Generally, the attic stairway insulator assembly includes a base, formed from substantially rigid insulative material, and a top, defined by a flexible jacket filled with insulative material. The base is configured for positioning over structural framing members forming the attic scuttle and the top is configured to drape over the base.

Figure 2:
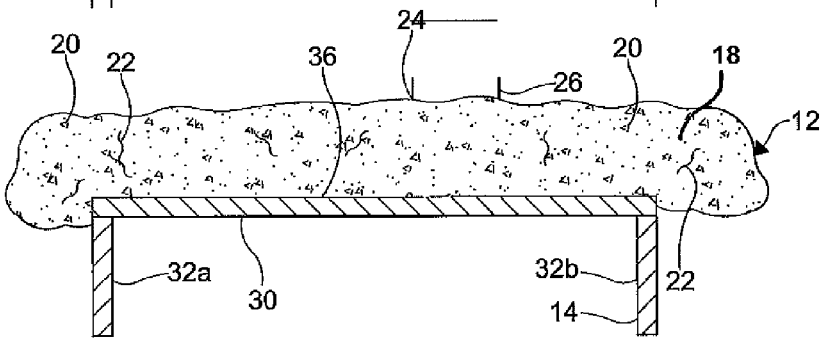
FIG. 2 is an assembled side view, in cross-section, of the attic stairway insulator assembly of FIG. 1.

Referring now to FIGS. 1 and 2, a first embodiment of the attic stairway insulator assembly (hereafter "insulator assembly") is illustrated in an exploded view at 10. Referring first to FIG. 1, the insulator assembly 10 includes a bag 12 and a base 14. As will be explained in more detail below, the bag 12 and the base 14 are each formed with insulative materials, and when joined together, form the insulator assembly 10. Referring now to FIG. 2, in an assembled arrangement, the bag 12 is sized and configured to "drape" over portions of the base 14. The term "drape", as used herein, is defined to mean portions of the bag 12 fall or hang over portions of the base 14.

Referring again to FIGS. 1 and 2, the bag 12 includes a jacket 16 that defines a cavity 18 therewithin. The jacket 16 is configured for flexibility, such that portions of the jacket 16 can drape or fall over and around other structures. The jacket 16 can be formed from various materials. In one embodiment, the jacket 16 can be formed from a continuous polymeric material. Non-limiting examples of the polymeric material forming the jacket 16 include polyethylene and polypropylene. However, other polymeric materials can be used. The jacket 16 can also be formed as a fibrous web of non-woven fibers, such as for example, fiberglass fibers.

While the material forming the jacket 16 is described above as being flexible, the material is also configured to substantially resist punctures and tears. In the illustrated embodiment, the material forming the jacket 16 has a thickness in a range of about 0.3 ounces per square yard to about 5.0 ounces per square yard. However, in other embodiments, the thickness of the material forming the jacket 16 can be less than about 0.3 ounces per square yard or greater than about 5.0 ounces per square yard, sufficient that the jacket can substantially resist punctures and tears.

Referring again to FIGS. 1 and 2, in certain embodiments the jacket 16 can include a plurality of perforations 20. The perforations 20 are configured to allow the jacket 16 to "breathe" (also referred to as "air permeability"). The terms "breathe" or "air permeability", as used herein, is defined to mean the jacket 16 can allow a desired quantity of air to pass through the jacket 16. The quantity, size, spacing, shape and arrangement of the perforations 20 are considerations in determining the air permeability of the jacket 16. The perforations 20 can have any desired size, spacing, shape and arrangement sufficient to affect the desired air permeability of the jacket 16.

Referring again to FIGS. 1 and 2, the jacket 16 envelops insulative material 22. In the illustrated embodiment, the insulative material 22 is a loosefill insulative material. The term "loosefill", as used herein, is defined to mean any insulative material formed from a multiplicity of discrete, individual tuffs, cubes, flakes, or nodules. The insulative material 22 can be made of glass fibers or other mineral fibers, and can also be polymeric fibers, organic fibers or cellulose fibers. The insulative material 22 can have a binder material applied to it, or it can be binderless.

While the jacket 16 illustrated in FIGS. 1 and 2 has been described as enveloping the loosefill insulative material 22, it should be appreciated that the jacket 16 can envelop with other forms and types of insulative materials formed from a multiplicity of discrete, individual tuffs, cubes, flakes, or nodules. Non-limiting examples of other forms and types of insulative materials include ground fiberglass batts and ground foamular boards.

Referring again to FIGS. 1 and 2, the jacket 16 includes an opening 24 formed in the jacket 16 and a closing structure 26. The opening 24 is configured to allow the insertion of insulative materials 22 into the jacket 16 and the closing structure 26 is configured to close the opening 24 after the insulative materials 22 are inserted into the jacket 16. The closing structure is further configured to substantially prevent insulative material 22 from exiting the opening 24. In the illustrated embodiment, the closing structure 26 is a zipper. Alternatively, the closing structure 26 can be other structures, devices or mechanisms configured to close the opening 24 in the jacket 16 after the insulative materials 22 are inserted into the jacket 16. Non-limiting examples of alternate closing structures include hook and loop structures, flaps or ports. In still other embodiments, the opening 24 can be closed with other methods, such as for example adhesives.

While the embodiment illustrated in FIGS. 1 and 2 illustrate the opening 24 and the closing structure 26 as being positioned atop the jacket 16, it should be appreciated that the opening 24 and the closing structure 26 can be positioned in other locations of the jacket 16, including the non-limiting example of a sidewall of the jacket 16.

In the embodiment illustrated in FIG. 1, the jacket 16 is filled with insulative material 22 as a distribution hose 28, having forced air entrained with the insulative material 22, is inserted into the opening 24. In other embodiments, the jacket 16 can be filled with insulative material 22 in other desired manners, including the non-limiting example of pouring the insulative material 22 into the opening 24 of the jacket 16. The jacket 16 is filled with a desired quantity of insulative material 22. As will be discussed in more detail below, the quantity of insulative material 22 within the jacket 16 is a factor in determining the resulting insulative value (R-value) of the insulator assembly 10. After the jacket 16 receives the desired quantity of insulative material 22, the closing structure 26 is closed and the bag 12 can be attached to the base 14. Attachment of the bag 12 to the base 14 will be discussed in more detail below.

Referring again to FIGS. 1 and 2, the base 14 includes a top 30, opposing sides 32*a*, 32*b* and opposing ends (not shown for purposes of clarity). The top 30, sides 32*a*, 32*b* and ends cooperate to form a hollow box, absent a bottom. The top 30, sides 32*a*, 32*b* and ends further define a base cavity 34. As will be discussed in more detail below, the base cavity 34 is sized and configured to receive a collapsed, segmented stair set, that in an extended arrangement, extends from the attic to a lower level position in the building.

Referring again to FIGS. 1 and 2, the top 30, sides 32*a*, 32*b* and ends of the base 14 are formed from folded sections of a rigid insulative material. The rigid insulative material is configured to provide structural, load-bearing characteristics to the base 14 that allows the base 14 to support the weight of the top 12. The rigid insulative material further provides an insulative value (R-value) of the insulator assembly 10. In the illustrated embodiment, the top 30, sides 32*a*, 32*b* and ends of the base 14 are formed from folded sections of insulated duct board, such as insulated duct board formed from a resin bonded fibrous glass board and having the following physical properties: maximum operating temperature limits of 250° F. (internal) and 150° F. (external) as measured by UL 181/ULC S110, maximum air velocity of 6,000 feet per minute as measured by UL 181/ULC S110, static pressure limit of ±2 inches w.g. as measured by UL 181/ULC S110, water vapor sorption (by weight) of <3% at 120° F., 95% R.H. at measured by ASTM C1104, mold growth meeting the requirements of UL 181/ULC S110, fungi resistance meeting the requirements of ASTM G21, bacterial resistance meeting the requirements of ASTM G22, surface burning characteristics of <25 for flame spread and <50 for smoke developed as measured by UL 723/ULC S102 and flame penetration of 30 minutes as measured by UL 181/ULC S110.

In the illustrated embodiment, the insulated duct board has a thickness TBD in a range of from about 1.0 inches to about 2.0 inches. Alternatively, the thickness TBD can be less than about 1.0 inches or more than about 2.0 inches, sufficient that the insulated duct board can provide structural, load-bearing characteristics to the base 14 that allows the base 14 to support the weight of the top 12. One non-limiting example of a suitable insulated duct board is QuietR® Duct Board, manufactured and marketed by Owens Corning Corporation, headquartered in Toledo, Ohio. However, it should be appreciated that in other embodiments, other insulated duct board or other rigid insulative material can be used. One non-limiting example of other suitable rigid insulative material is foamular board.

Referring again to FIGS. 1 and 2, the top 30 has an exterior surface 36, the sides 32*a*, 32*b* have exterior surfaces 38*a*, 38*b* respectively, and the ends have exterior surfaces (not shown). The exterior surfaces 36, 38*a*, 38*b* are covered with a facing material. The facing material is configured for desired air sealing and draft reduction characteristics. The facing material further provides the exterior surfaces 36, 38*a*, 38*b* with high emissivity, such that the surfaces substantially resist radiant heat transfer. It should be noted that the interior surfaces of the top 30, sides 32*a*, 32*b* and ends, that is the surfaces facing the cavity 34, are not covered with a facing.

In the illustrated embodiment, the facing material is a foil material. In other embodiments, the facing material can be other materials, such as for example, a foil reinforced kraft (FRK) material, sufficient to provide desired air sealing, draft reduction and emissivity characteristics.

Referring again to FIG. 1, the base 14 has a length L1, a width (not shown) and a height H1. As discussed above, the length L1, width and height H1 are configured to receive a collapsed, segmented stair set. In the illustrated embodiment, the length L1 is about 54.0 inches, the width is in a range of from about 22.0 inches to about 30.0 inches and the height H1 is in a range of from about 6.0 inches to about 12.0 inches. It should be appreciated that in other embodiments, the length L1 can be more or less than about 54.0 inches, the width can be less than about 22.0 inches or more than about 30.0 inches and the height H1 can be less than about 6.0 inches or more than about 12.0 inches, sufficient that the resulting cavity 34 can receive a collapsed, segmented stair set.

Referring again to FIG. 1, the bag 12 has a general length L2, a width (not shown) and a general height (H2). As shown in FIG. 2, the length L2 of the bag 12 is longer that the length L1 of the base 14, such that portions of the bag 12 drape over the sides 32*a*, 32*b* of the base 14. While not shown in FIG. 2, it is also contemplated that the width of the bag 12 is greater than the width of the base 14 such that portions of the bag 12 drape over the ends of the base 14.

Referring again to FIG. 2, subsequent to the formation of the bag 12 and the base 14 at the building site, the insulator assembly 10 is formed by positioning the base 14 to cover the building scuttle with the open side of the base 14 facing the lower building floor. Next, the bag 12 is seated on the exterior surface 36 of the top 30 of the base 14. In certain embodiments, the top 12 is attached to the base 14 with the use of adhesives. In other embodiments, the top 12 can be attached to the base 14 with other mechanisms, devices and structures, including, but not limited to clips, clamps, and hook and loop fasteners. Insulative material 22 is then inserted into the bag 12 and the opening 24 in the bag 12 is closed.

Figure 3:
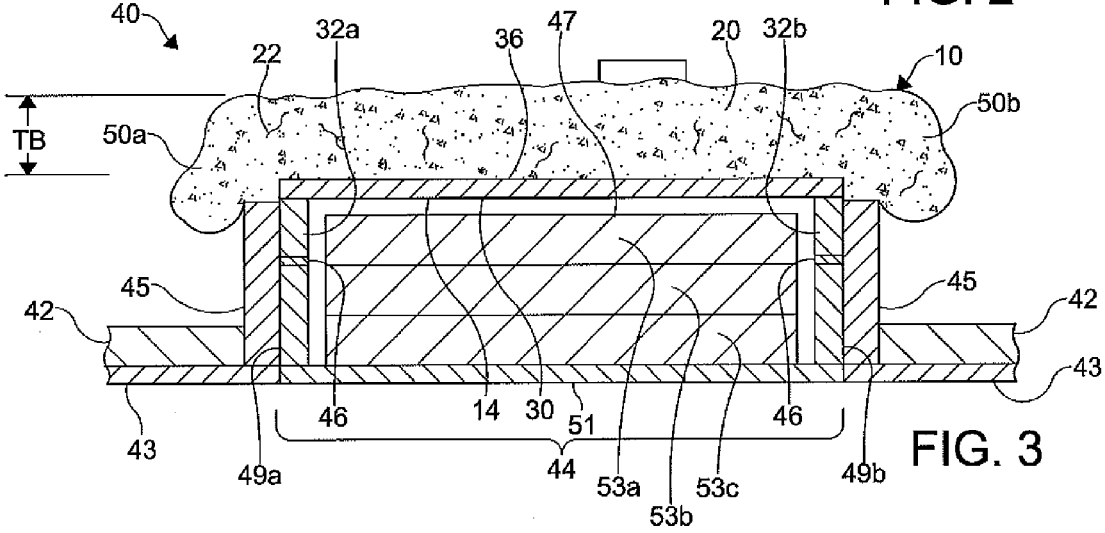
FIG. 3 is a side view, in cross-section, of the attic stairway insulator assembly of FIG. 2 positioned in a first embodiment of a building scuttle.

Referring now to FIG. 3, a first embodiment of an insulator assembly 10 installed over a building scuttle 40 is illustrated. The building scuttle 40 is positioned among horizontally oriented ceiling joists 42 and ceiling materials 43 attached to the ceiling joists 42. In the illustrated embodiment, the ceiling joists 42 are framing members made from wood. However, in other embodiments, the ceiling joists 42 can be other desired framing members, including the non-limiting examples of steel studs or wood lathe. In the illustrated embodiment, the ceiling materials 43 are drywall panels. Alternatively, the ceiling materials 43 can be other materials including the non-limiting examples of plaster or tiles.

Referring again to FIG. 3, a plurality of framing members 45 are arranged in a manner such as to define an opening 44. In the illustrated embodiment, the framing members 45 are made from wood. However, in other embodiments, the framing members 45 can be other desired framing members, including the non-limiting examples of steel studs or wood lathe. The opening 44 is sized for receiving a segmented stair set, shown schematically at 47. The opening 44 can have any desired dimensions sufficient for receiving a segmented stair set 47.

The segmented stair set 47 includes scuttle framing members 49*a*, 49*b*, stair segments 53*a*, 53*b*, 53*c* and a stair cover 55.

Referring again to FIG. 3, in operation, the scuttle framing members 49*a*, 49*b* are attached to the framing members 45 such that the segmented stair set 47 is securely positioned in the attic. Next, the base 14 of the insulator assembly 10 is positioned over the opening 44 such that the sides 32*a*, 32*b* of the base 14 and the ends (not shown) of the base 14 seat upon the scuttle framing members 49*a*, 49*b*. In this position, the top 30 of the base 14 spans the opening 44. Also in this position, the sides 32*a*, 32*b* and ends of the base 14 and the framing members 45 are positioned substantially adjacent to each other. The bag 12, filled with insulative materials 22, is shown in a seated position with the base 14. As discussed above, the length and width of the bag 12 are greater than the length and width of the base 14. Accordingly, portions 50*a*, 50*b* of the bag 12 drape over the sides 32*a*, 32*b* and ends of the base 14 and over the sides of the framing members 45.

Referring again to FIG. 3, in certain embodiments a gasket 46 is positioned between the sides 32*a*, 32*b* and ends of the base 14 and the scuttle framing members 49*a*, 49*b*. The gasket 46 is configured as an air sealing structure. In the illustrated embodiment, the gasket 46 is a compressible foam material, such as that used as sill plate gaskets. One non-limiting example of a gasket is the FoamSeal® Sill Gasket, manufactured and marketing by Owens Corning Corporation, headquartered in Toledo, Ohio. However, it should be appreciated that in other embodiments, other gaskets sufficient to provide an air sealing structure, can be used.

Referring again to FIG. 3, the insulative assembly 10 provides an insulative value (R-value) to the building scuttle 40. The R-value of the insulative assembly 10 is a combination of the R-value of the bag 12 and the R-value of the base 14. The R-value of the bag 12 is determined, in part, by the density of the insulative material 22 and the thickness TB of the insulative material 22 within the jacket 16. In the illustrated embodiment, the insulative material 22 has a density in a range from about 0.2 lbs/ft$^3$ (3.2 kg/m$^3$) to about 5.0 lbs/t$^3$ (80.1 kg/m$^3$) and a thickness TB in a range of from about 1.0 inches (2.54 cm) to about 10.0 inches (25.4 cm). The combination of density and thickness of the insulative material 22 results in an insulative value (R-value) of the bag 12 in a range of from about R-11 to about R-38. In other embodiments, the bag 12 can have insulative values less than about R-11 or more than R-38 as a result of combinations of densities less than about 0.2 lbs/ft$^3$ (3.2 kg/m$^3$) or more than about 5.0 lbs/ft$^3$ (80.1 kg/m$^3$) and thicknesses TB less than about 1.0 inches (2.54 cm) or more than about 10.0 inches (25.4 cm).

The R-value of the base 14 is determined by the thickness TDB of the duct board material. As examples, a thickness TDB of the duct board material of 1.0 inch results in an insulative value of the base 14 of R-4.3, a thickness TDB of 1.5 inches results in an insulative value of the base 14 of R-6.0 and a thickness TDB of 2.0 inches results in an insulative value of the base 14 of R-8.0. Advantageously, the insulator assembly 10 is configured to provide a high R-value level, which can be as high as R-50 or more. In certain embodiments, the combination of the R-value of the bag 12 and the R-value of the base 14 is at least equivalent to the R-value of the surrounding attic insulation (not shown).

Figure 4:
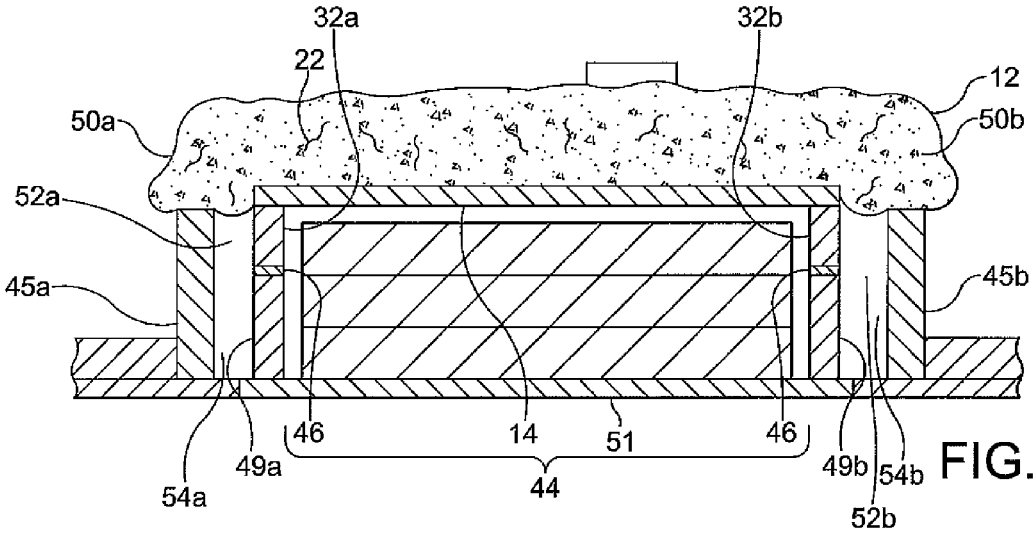
FIG. 4 is a side view, in cross-section, of the attic stairway insulator assembly of FIG. 2 positioned in a second embodiment of a building scuttle.

As discussed above, the bag 12, filled with insulative materials, is flexible. The flexibility of the bag 12 allows flexibility in the installation of the insulative assembly 10. Referring now to FIG. 4, a second installation scenario is illustrated. In this scenario, positioning of the base 14 as discussed above over the opening 44 results in the sides 32*a*, 32*b* of the base 14 being positioned close to the framing members 45*a*, 45*b*. As discussed above, the bag 12, filled with insulative materials 22, is shown in a seated position with the base 14. Since the length and width of the bag 12 are greater than the length and width of the base 14, portions 50*a*, 50*b* of the bag 12 drape over the sides 32*a*, 32*b* and ends of the base 14. In addition, the portions 50*a*, 50*b* of the bag 12 substantially straddle the framing members 45*a*, 45*b* such that a first segment 52*a* extends into a cavity 54*a* formed between the side 32*a* of the base 14 and the framing member 45*a* and a second segment 52*b* extends into a cavity 54*b*. This embodiment is illustrative of the flexibility of the bag 12 that advantageously allows the insulative assembly 10 to adapt to varying installation conditions by substantially filling the available cavities adjacent the insulative assembly 10.

While the embodiment illustrated in FIG. 4 shows portions of the bag 12 straddling the framing members 45*a*, 45*b*, in other embodiments the framing members 45*a*, 45*b* can be sufficiently close to the sides 32*a*, 32*b* of the base 14 such that portions of the bag 12 cannot fit between the framing members 45*a*, 45*b* and the sides 32*a*, 32*b*. In these embodiments, the bag 12 is configured to drape over the framing members 45*a*, 45*b*.

Figure 5A:
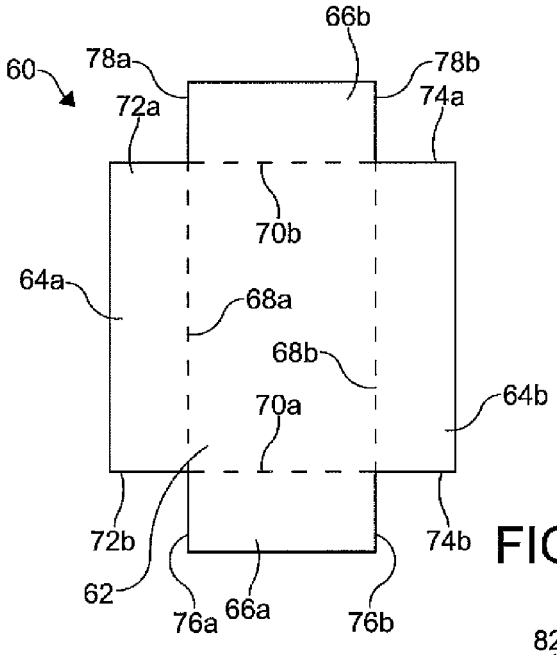
FIG. 5A is a plan view of a first embodiment of a base blank.

As discussed above, the top 30, sides 32*a*, 32*b* and ends of the base 14 are formed from folded sections of a rigid insulative material. Referring now to FIG. 5A, a base blank 60 is indicated generally at 60. The base blank 60 will be folded into a base 14.

As shown in FIG. 1, the base blank 60 includes a top panel 62, side panels 64*a*, 64*b* and end panels 66*a*, 66*b*. The side panels 64*a*, 64*b* are divided from the top panel 62 by foldlines 68*a*, 68*b*. Similarly, the end panels 66*a*, 66*b* are divided from the top panel 62 by foldlines 70*a*, 70*b*. The side panel 64*a* has end edges 72*a*, 72*b* and the side panel 64*b* has end edges 74*a*, 74*b*. Similarly, end panel 66*a* has end edges 76*a*, 76*b* and end panel 66*b* has end edges 78*a*, 78*b*.

Figure 5B:
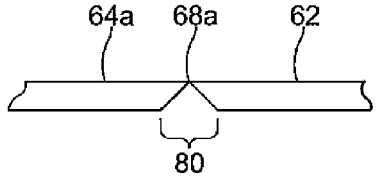
FIG. 5B is a side view, in elevation, of a cutout, top panel, side panel and a pre-folded foldline for the base blank of FIG. 5A.

Referring now to FIG. 5B, foldline 68*a* positioned between the top panel 62 and the side panel 64*a* as illustrated. A cutout 80 is formed in the top panel 62 and the side panel 64*a* to facilitate bending of the foldline 68*a*. In the illustrated embodiment, the cutout 80 has the cross-sectional shape of a V-groove. As will be discussed in more detail below, cutouts having other shapes and configurations can be used to facilitate bending of the foldline 68*a*.

Figure 5C:
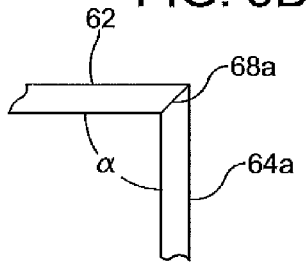
FIG. 5C is a side view, in elevation, of a joint formed by the folded top panel and side panel of FIG. 5B.

Referring now to FIG. 5C, the top panel 62 and the side panel 64*a* are shown in a folded arrangement. In the folded arrangement, the intersection of top panel 62 and the side panel 64*a* at the foldline 68*a* forms a joint having structural integrity sufficient to support the weight of the bag 12. An angle $\alpha$ is formed between the top panel 62 and the side panel 64*a*. In the illustrated embodiment, the angle $\alpha$ is in a range of about 80° to about 100°. It should be appreciated that in other embodiments, the angle $\alpha$ can be any desired angle sufficient that the resulting joint provides structural integrity to the resulting base sufficient to support the weight of the bag 12.

Figure 5D:
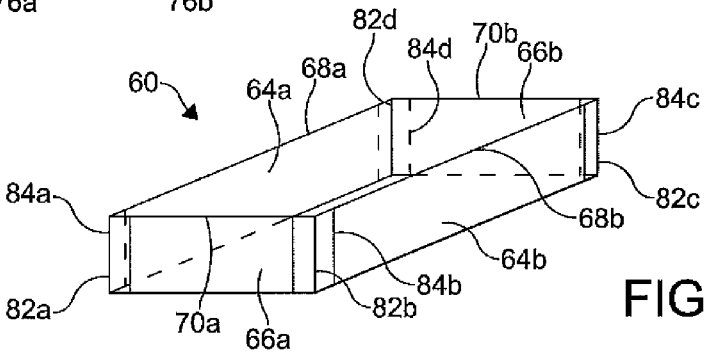
FIG. 5D, is a perspective view of the assembled base of FIG. 1 formed by the base blank of FIG. 5A.

Returning now to FIG. 5A, foldlines 68*b*, 70*a* and 70*b* have V-groove cutouts similar to foldline 68*a* to facilitate bending the respective panels. As shown in FIG. 5D, the base 14 is formed by bending the side panels 64*a*, 64*b* at the foldines 68*a*, 68*b* and bending the end panels 66*a*, 66*b* at the foldlines 70*a*, 70*b*. Corners 82*a*-82*d* are formed between the end edges 72*a*, 72*c*, 74*a*, 74*c* of the side panels 64*a*, 64*b* and the end edges 76*a*, 76*c*, 78*a*, 78*c* of the end panels 66*a*, 66*b*. Fasteners 84*a*-84*d* are applied to the corners 82*a*-82*d* and used to retain the folded side panels 64*a*, 64*b* and end panels 66*a*, 66*b* in the folded position. In the illustrated embodiment, the fasteners 84*a*-84*b* are sections of foil-based tape. The foil-based tape advantageously provides the base 14 with additional thermally reflective characteristics. However, it should be appreciated that in other embodiments, the fasteners 84*a*-84*b* can be other structures, mechanisms and devices sufficient to retain the side panels 64*a*, 64*b* and end panels 66*a*, 66*b* in the folded position.

Referring again to FIG. 5A, the base blank 60 can be shipped to a building site in an unfolded, flat sheet condition and subsequently folded into the base 14. Advantageously, this allows for easy and cost effective shipment. In a similar manner, the bag 12 can be shipped to a building site prior to the insertion of the insulative materials. Accordingly, the bag can be shipped in a relatively compact condition, thereby also allowing for easy and cost effective shipment.

Figure 6A:
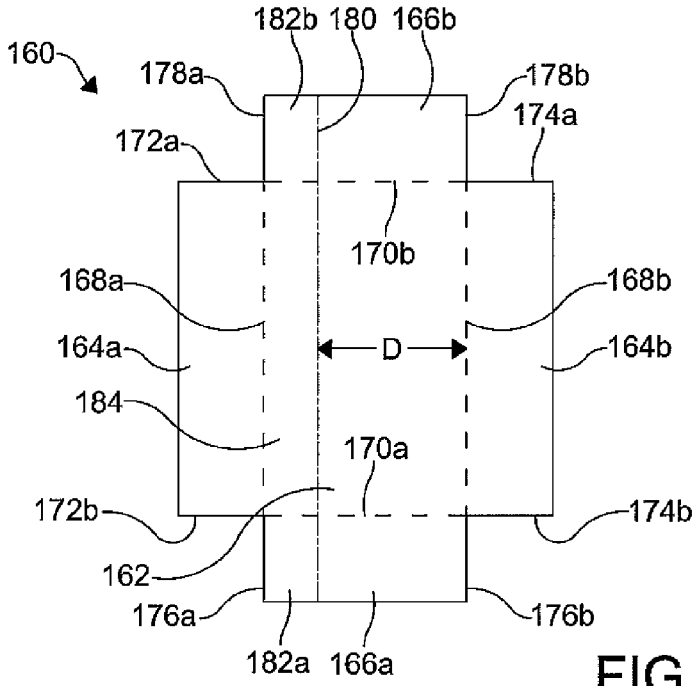
FIG. 6A is a plan view of a second embodiment of a base blank.

While the embodiment of the base 14 illustrated in FIGS. 1-3 is described above as having certain dimensions, it is within the contemplation of this invention that a base blank could provided in which the folded base dimensions are adjustable at a work site. Referring now to FIG. 6A, an alternate base blank 160 is illustrated. As described above, the base blank 160 will be formed into a base.

Referring again to FIG. 6A, the base blank 160 includes a top panel 162, side panels 164*a*, 164*b* and end panels 166*a*,

166*b*. The side panels 164*a*, 164*b* are divided from the top panel 162 by foldlines 168*a*, 168*b*. Similarly, the end panels 166*a*, 166*b* are divided from the top panel 162 by foldlines 170*a*, 170*b*. The side panel 164*a* has end edges 172*a*, 172*b* and the side panel 164*b* has end edges 174*a*, 174*b*. Similarly, end panel 166*a* has end edges 176*a*, 176*b* and end panel 166*b* has end edges 178*a*, 178*b*.

Referring again to FIG. 6A, the base blank 160 includes a cut line 180 that extends from the end panel 166*a* to the end panel 166*b*. As will be explained in more detail below, the cut line 180 facilitates trimming of the base blank 160, such that the a single size base blank 160 can be fit to building scuttles having various widths. A distance D is formed between the cut line 180 and the foldline 168*b*. The distance D represents the width of the opening 44 as shown in FIG. 3. In operation, an installer cuts the base blank 160 along the cut line 180 and discards portions 182*a*, 182*b* of the end panels 166*a*, 166*b* still connected to the side panel 164*a*. Next, a portion 184 of the top panel 162 still connected to the side panel 164*a* is removed.

Figure 6B:
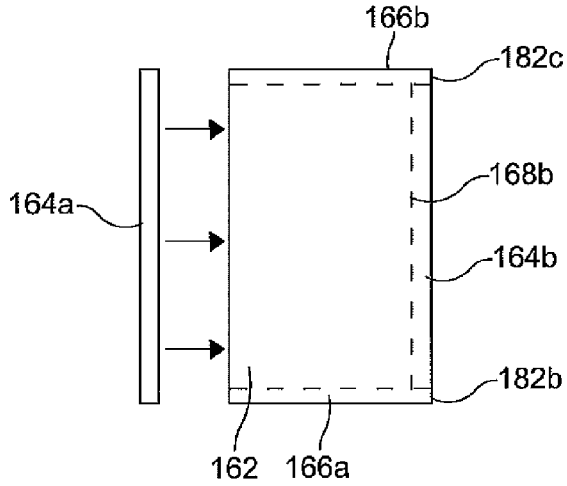
FIG. 6B is a plan view, of the base blank of FIG. 6A shown in a partially assembled arrangement.
Figure 6C:
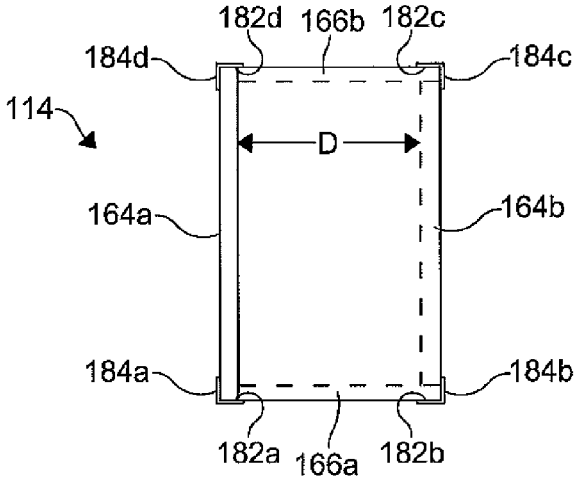
FIG. 6C is a plan view, of the base blank of FIG. 6A shown fully assembled.

Referring now to FIG. 6B, a base 114 is formed by bending the side panel 164*b* at the foldine 168*b* and bending the end panels 166*a*, 166*b* at the foldlines 170*a*, 170*b*. Corners 182*b*, 182*c* are formed between the side panel 164*b* and the end panels 166*a*, 166*b*. As shown in FIG. 6C, fasteners 184*b*, 184*c* are applied to the corners 182*b*, 182*c* and used to retain the folded side panel 164*b* and end panels 166*a*, 166*b* in the folded position.

Referring again to FIG. 6B, as a next step, the side panel 164*a* is positioned against the cut edges of the top panel 162 and the end panels 166*a*, 166*b*. Referring now to FIG. 6C, corners 182*a*, 182*d* are formed between the side panel 164*a* and the end panels 166*a*, 166*b*. Again, fasteners 184*a*, 184*d* are applied to the corners 182*a*, 182*d* and used to retain the cut side panel 164*a* and end panels 166*a*, 166*b* in the assembled position. The assembled base 114 has the distance D between the side panels 164*a*, 164*b* corresponding the width of the opening 44 as shown in FIG. 3. Advantageously, the cut line 180 can provide any distance D, resulting in a base blank 160 suitable for field width adjustment.

In the embodiment illustrated in FIG. 6C, the fasteners 184*a*-184*d* are the same as, or similar to, the fasteners 84*a*-84*d* described above and shown in FIG. 5D. sections of foil-based tape. However, it should be appreciated that the fasteners 184*a*-184*d* can be different than the fasteners 84*a*-84*d*.

Figure 7:
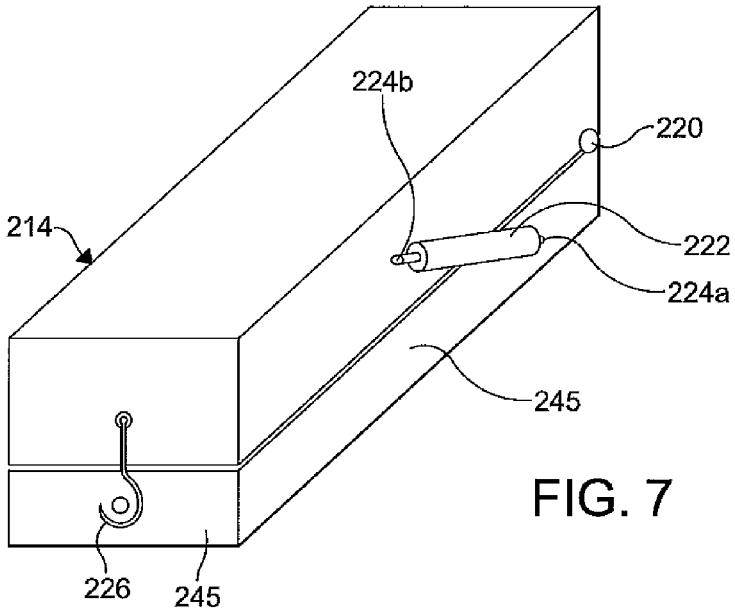
FIG. 7 is a perspective view of a second embodiment of a base for forming an attic stairway insulator assembly, shown in a closed arrangement.
Figure 8:
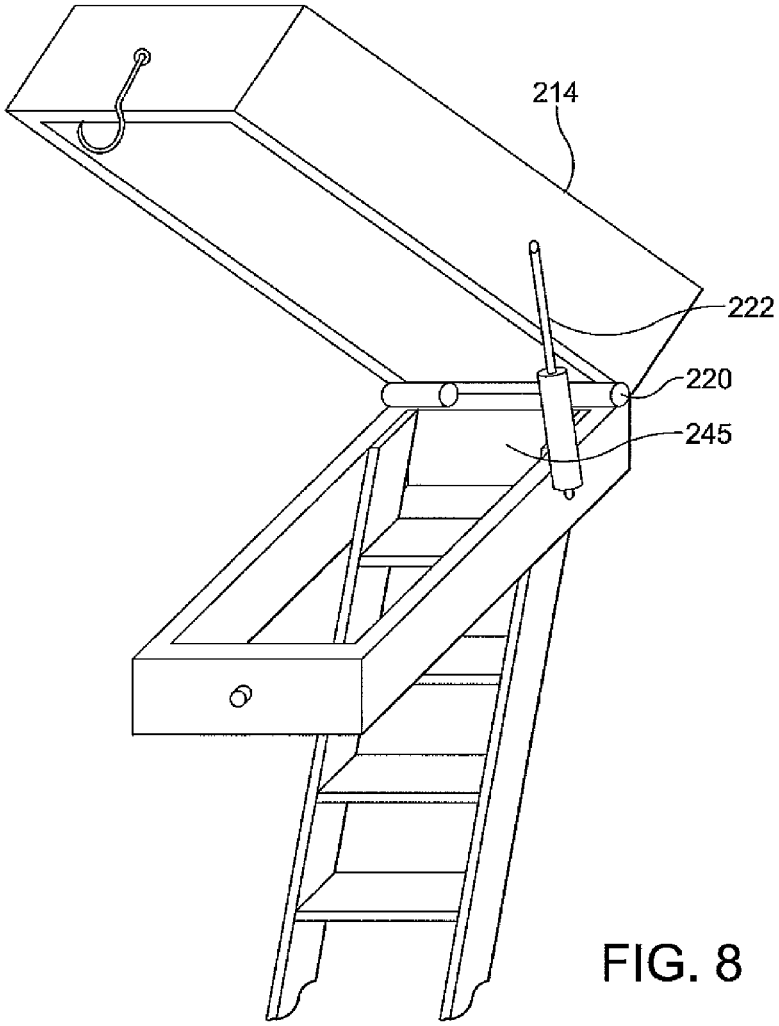
FIG. 8 is a perspective view of the second embodiment of a base for forming an attic stairway insulator assembly, shown in an open arrangement.

Referring now to FIGS. 7 and 8, another embodiment of assembled base of an attic stairway insulator assembly is illustrated. In this embodiment, an assembled base 214 is provided with a hinge 220 and with one or more supports 222. The hinge 220 allows the base 214 to pivot from a closed position (seated against scuttle framing members 245 forming the building scuttle as shown in FIG. 7) to an open position (having a space between the base 214 and the scuttle framing member 245 forming the building scuttle as shown in FIG. 8). The opening position of the base 214 shown in FIG. 8 is configured to allow ease of entry into the attic space of the building.

In the embodiment illustrated in FIGS. 7 and 8, the hinge 220 is a conventional butt hinge that extends substantially along the width of the base 214. However, in other embodiments, other types of hinges and more than a single hinge can be used sufficient to allow the base 214 to pivot from a closed position to an open position.

Referring again to FIGS. 7 and 8, the supports 222 are configured to support the base 214 in an open position such that the base 214 remains in an open position until the base 214 is urged back to the closed position. As shown in FIGS. 7 and 8, a first end 224*a* of the support 222 is connected to a framing member 245 and a second end is connected to the base 214. In the illustrated embodiment, the support 222 is a conventional air spring. Alternatively, other types of supports can be used sufficient to support the base 214 in an open position until the base 214 is urged back to a closed position.

Referring again to the embodiment illustrated in FIGS. 7 and 8, optionally the base 214 can be fitted with a latch 226. The latch 226 is configured to prevent unintended opening of the base 214. In the illustrated embodiment, the latch 226 is a mechanical structure. However, the latch 226 can have other forms, such as the non-limiting examples of magnetic contacts and hook and loop fasteners. The latch 226 can coupled the scuttle framing members 245 and the base 214 in any desired manner.

Figure 9A:
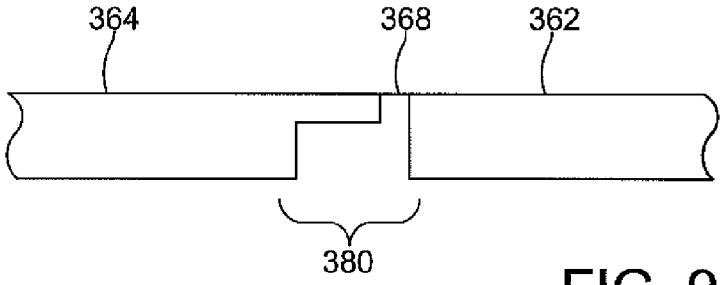
FIG. 9A is a side view, in elevation, of a cutout, top panel, side panel and a pre-folded foldline for the an alternate base blank.

As described above, the base is formed from folding panels of a base blank. Folding of the panels is facilitated by foldlines and associated cutouts formed in adjacent panels. In the embodiment shown in FIG. 5B, the cutout has the cross-sectional shape of a V-groove. Referring now to FIG. 9A, another non-limiting cross-sectional shape of a cutout is illustrated. In this embodiment, foldline 368 is positioned between the top panel 362 and the side panel 364. A cutout 380 is formed in the top panel 362 and the side panel 364 to facilitate bending of the foldline 368. In the illustrated embodiment, the cutout 380 has the cross-sectional shape of a conventional shiplap joint.

Figure 9B:
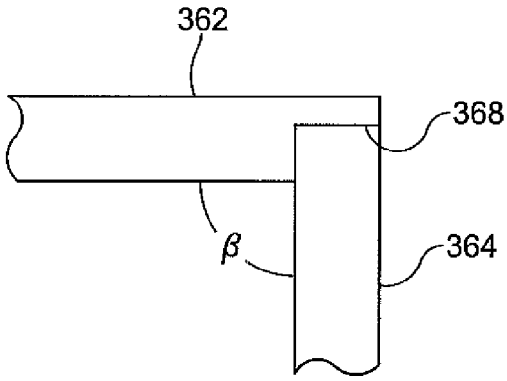
FIG. 9B is a side view, in elevation, of a joint formed by the folded top panel and side panel of FIG. 9A.

Referring now to FIG. 9B, the top panel 362 and the side panel 364 are shown in a folded arrangement. In the folded arrangement, the intersection of top panel 362 and the side panel 364 at the foldline 368 forms the shiplap joint having structural integrity sufficient to support the weight of the bag 12. As discussed above, an angle β is formed between the top panel 362 and the side panel 364. In the illustrated embodiment, the angle β is in a range of about 80° to about 100°. It should be appreciated that in other embodiments, the angle β can be any desired angle sufficient that the resulting joint provides structural integrity to the resulting base sufficient to support the weight of the bag 12.

While the embodiment of the bag 12 illustrated in FIGS. 1-3 is described above as a single inflatable structure, it is within the contemplation of this invention that the bag can be formed of individual discrete segments. In operation, the individual discrete segments can connected together and to the top of the base or the individual discrete segments can be individually connected to the base without being connected to each other. The individual discrete segments are tillable with any desired insulative material, including the loosefill insulative material discussed above. It is also within the contemplation of this invention that the individual segments forming the bag are stackable upon each other, such as to facilitate ease of entry into the attic space.

The principle and mode of operation of the attic stairway insulator have been described in certain embodiments. However, it should be noted that the attic stairway insulator may be practiced otherwise than as specifically illustrated and described without departing from its scope.

What is claimed is:

1. An attic stairway insulator assembly configured for placement within a building scuttle, the building scuttle having a length and a width, the attic stairway insulator assembly comprising:

a base configured to cover the building scuttle, the base having a length and a width corresponding generally to the length and the width of the building scuttle; and a bag seated on the base and having insulative material within a jacket, the bag having a length that is longer than the length of the base and a width that is wider than the width of the base such that portions of the bag having the insulative material drape over portions of the base.

2. The attic stairway insulator assembly of claim 1, wherein the base has the structure of a hollow box, absent a bottom.

3. The attic stairway insulator assembly of claim 1, wherein the base is formed from folded panels and the folded panels are formed from insulated duct board.

4. The attic stairway insulator assembly of claim 3, wherein exterior surfaces of the panels forming the base have a foil facing.

5. The attic stairway insulator assembly of claim 3, wherein the panels forming the base provide an insulative value in a range of from about R-4.3 to about R-8.

6. The attic stairway insulator assembly of claim 3, wherein foldlines and cutouts are formed between the panels forming the base.

7. The attic stairway insulator assembly of claim 6, wherein the cutouts are configured to form shiplap joints in adjacent panels.

8. The attic stairway insulator assembly of claim 1, wherein the jacket is formed from a flexible material.

9. The attic stairway insulator assembly of claim 1, wherein the jacket includes a plurality of perforations configured to allow air to flow through the jacket.

10. The attic stairway insulator assembly of claim 1, wherein the insulative material within the bag is loosefill insulation material.

11. A method of insulating a building scuttle, the building scuttle having a length and a width, the method comprising the steps:

covering the building scuttle with a base, the base having a length and a width corresponding generally to the length and the width of the building scuttle;

seating a bag on the base, the bag having a length that is longer than the length of the base and a width that is wider than the width of the base; and inserting insulative material into the seated bag such that portions of the bag having the insulative material drape over portions of the base.

12. The method of claim 11, wherein the base has the structure of a hollow box, absent a bottom.

13. The method of claim 11, wherein the base is formed from folded panels and the folded panels are formed from insulated duct board.

14. The method of claim 13, wherein exterior surfaces of the panels forming the base have a foil facing.

15. The method of claim 13, wherein the panels forming the base provide an insulative value in a range of from about R-4.3 to about R-8.

16. The method of claim 13, wherein foldlines and cutouts are formed between the panels forming the base.

17. The method of claim 16, wherein the cutouts are configured to form shiplap joints in adjacent panels.

18. The method of claim 1, wherein the bag is formed from a flexible material.

19. The method of claim 1, wherein the bag includes a plurality of perforations configured to allow air to flow through the bag.

20. The method of claim 1, wherein the insulative material within the bag is loosefill insulation material.

* * * * *